United States Patent [19]

Kaiserswerth et al.

[11] 3,982,814

[45] Sept. 28, 1976

[54] DAMPENED CHOKE COIL

[75] Inventors: Hans-Peter Kaiserswerth, Regensburg; Josef Wimmer, Wenzenbach; Rudolf Schaller, Regensburg, all of Germany

[73] Assignee: Siemens Aktiengesellschaft, Berlin & Munich, Germany

[22] Filed: Mar. 9, 1973

[21] Appl. No.: 339,739

[30] Foreign Application Priority Data

Mar. 17, 1972 Germany ..... 2213118
Mar. 17, 1972 Germany ..... 2213186

[52] U.S. Cl. ..... 323/78; 317/99; 336/69; 336/180; 336/221; 338/211

[51] Int. Cl.[2] ..... G05F 3/00

[58] Field of Search ..... 336/220, 83, 221, 180, 336/222, 223, 105; 323/74, 76, 77, 78; 333/79, 70 S, 70 CR; 338/211, 212; 317/99

[56] References Cited

UNITED STATES PATENTS

| | | | |
|---|---|---|---|
| 1,801,479 | 4/1931 | Ballentine | 336/220 |
| 2,683,673 | 7/1954 | Silversher | 338/211 |
| 2,692,372 | 10/1954 | Goldstine | 336/222 X |
| 2,823,361 | 2/1958 | Hopkins et al. | 323/76 X |
| 2,976,502 | 3/1961 | Hill | 336/83 |
| 3,176,217 | 3/1965 | Matsushima et al. | 336/105 X |
| 3,295,055 | 12/1966 | Matsushima et al. | 336/83 X |
| 3,295,056 | 12/1966 | Matsushima et al. | 323/78 |

*Primary Examiner*—Thomas J. Kozma
*Attorney, Agent, or Firm*—Hill, Gross, Simpson, Van Santen, Steadman, Chiara & Simpson

[57] ABSTRACT

A dampened choke coil structure having a ferromagnetic core and a winding of wire disposed about the core to form a choke coil. A second winding of substantially higher resistance material is wound generally parallel to the choke winding either inside or outside thereof. The number of turns of the two windings differ by more than 25%. In this way, parasitic capacitances are caused to have a decreased effect on the choke coils.

6 Claims, 7 Drawing Figures

DAMPENED CHOKE COIL

BACKGROUND OF THE INVENTION

Field of the Invention

The field of art to which this invention pertains is choke coil structures, and in particular, to such structures having arrangements to dampen resonant points operating at high frequencies.

SUMMARY OF THE INVENTION

It is an important feature of the present invention to provide an improved dampened coil structure.

It is another feature of the present invention to provide a dampened coil structure with a low and high resistance winding on a single core.

It is an object of the present invention to provide a dampening means for a coil structure which is compact, inexpensive and which effectively eliminates resonance points in the frequency range of operation.

It is a further object of the present operation to provide a coil structure of the type described above wherein the choke coil is wound about a core and the dampening coil consist of a high resistance coil having a substantially different number of turns than the number of turns of the choke coil.

It is also an object of the present invention to provide a coil structure described above wherein the number of turns of the two windings differ by more than 25%.

These and other objects, features and advantages of the present invention will be understood from the following description and the associated drawings wherein reference numerals are utilized to designate a preferred embodiment.

DESCRIPTION OF THE PREFERRED EMBODIMENT

Figure 1:
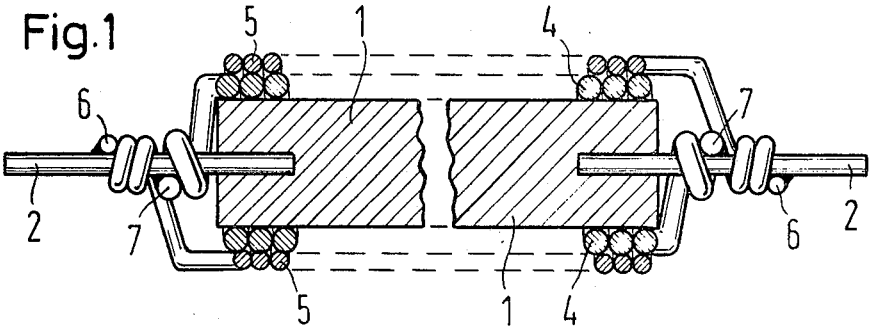
FIGS. 1 through 3 are sectional views of coil structures according to the present invention.

The present invention relates to a dampened choke coil having a ferromagnetic core and a winding of wire on the core. Choke coils are frequently used for wide frequency ranges. Often the choke coil will form a resonant circuit with capacitances inherent in the device such as parasitic capacitances. The result is current or voltage magnification which is undesirable. These undesirable effects however are avoided if the Q of the circuit is maintained equal or smaller than 1.

In order to achieve this low Q factor, a resistor may be connected in parallel with the choke coil and the value of the resistance may, for instance, be equal to the internal impedance of the choke at the resonant frequency. In most cases, it is preferable not to have such a resistor since it involves an additional component which must be installed involving some expense. High cost and a need to conserve space are factors in many circuit arrangements, and in addition, insulation may be required which involves additional expense.

It is already known to apply the winding of a choke directly onto a cylindrical electric resistor, for instance, a carbon layer resistor. Such a choke, however, has very little self inductance, so that the choke is effective only at high frequencies.

Also, there is known a high frequency coil with a ferrite core and an applied winding wherein the core and the coil are surrounded with a magnetically conductive coating consisting of a ferrite powder with high specific resistance which is bound by a plastic. In this way, dampening of the coil increases with increasing frequency, however, self induction decreases. Most ferromagnetic materials show such a result if they are not specifically designed for high frequency use.

The present invention is a solution to the problem of finding a dampened choke coil in which the undesirable influence of resonant amplification are eliminated without the need to construct a coil substantially larger.

In this invention, this problem is solved by providing a second winding of a relatively high resistance material parallel to the choke winding. Also, the number of turns of both windings differs by more than 25%.

The ferromagnetic core can consist of ferrite material, carbonyl iron or other suitable sheet metal. It is desirable that the resistance of the second winding be independent in value from the frequency of operation in contrast to the use of loss prone magnetic material which is strongly frequency dependent. It is a decisive advantage of this invention that existing manufactured devices can be used without being modified.

The second winding of the arrangement preferably consists of a resistance wire which does not have a dc connection with the choke winding and which has more turns than the choke winding. If the resistor is wound in direct proximity to the choke winding, either directly under or over the same, both are strongly coupled with each other. The ends of the resistor winding can simply be attached with a glue on the carrier member and do not require a solder connection with the outer connecting parts.

Another form of the invention requires the second winding to be also a resistor wire, but to have a dc connection with the choke winding. In this arrangement, the resistor wire has less turns than the choke winding. In this embodiment, the ends of the resistor wire are soldered with the ends of the choke winding. Thus a mechanical fixing of the ends of the resistor wires is achieved in an easy way without additional work. In addition, the amount of resistor wire which is required in this sample embodiment is less than in the above device.

According to a further embodiment of the invention, the second winding may consist of a resistance layer which is directly applied to the coil core. This layer may preferably be wound on the core.

Figure 6:
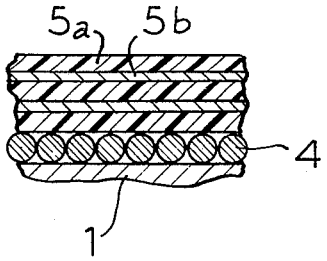
FIG. 6 shows a multiple layer foil arrangement as the high resistance coil.
Figure 7:
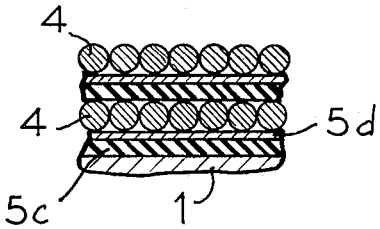
FIG. 7 shows the resistance winding as metalized paper layers between choke winding layers.

The resistance layer may also be formed of a plastic foil which is coated with a resistance material, for instance, chrome, nickel. This foil is wound in a number of windings over the choke winding. FIG. 6 shows such a foil arrangement. The foil is shown as 5*a* and the resistance layer is 5*b*. Instead of a plastic foil, metallized or impregnated paper can also be used. The close spatial contact between the choke winding and resistance winding is particularly important in the case where there is no dc connection between the resistance layer and the choke winding. In the case of coils which are wound in the form of multiple layers, the previously described embodiments can be used. Especially suited in such cases, however, is the use of a metallic foil of metallized paper which is wound between the individual layers of the choke as illustrated in FIG. 7. The paper is shown as 5*c* and the metallized layer is 5*d*.

Referring to the figures in greater detail, FIG. 1 shows a partially sectioned view of a coil according to the invention. A ferromagnetic core 1 is shown as having connection parts 2 at opposite ends. A first winding 4 of resistance wire is wound on the core 1, and a second winding 5 of copperlaquer wire is wound on top of the winding 4. The ends of the two windings are fastened with a soldered connection such as at 6 or 7, respectively to the outer connection parts.

Figure 2:
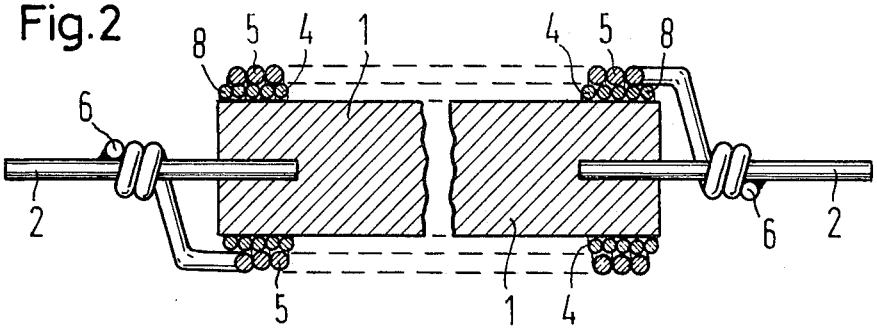

FIG. 2 shows another arrangement of the present invention wherein the resistance wire is dc isolated from the choke wire and has more turns than the choke wire.

Figure 3:
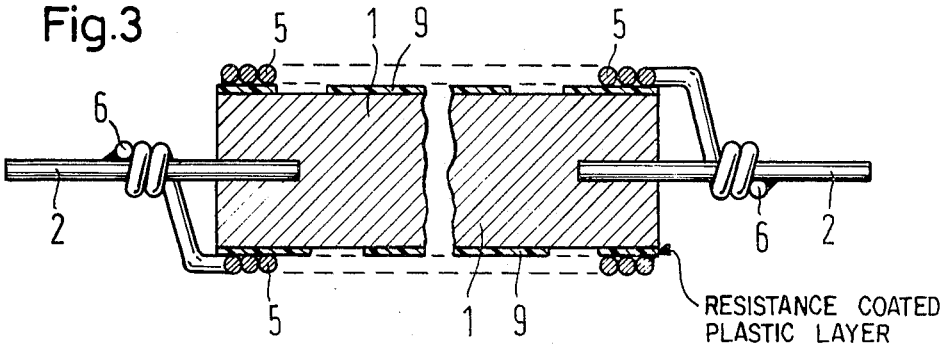

FIG. 3 is another arrangment of the present invention wherein the resistance layer is in the form of a plastic foil and is wound directly on the core 1. In this case the foil coated plastic layer is identified by the numeral 9.

Figure 4:
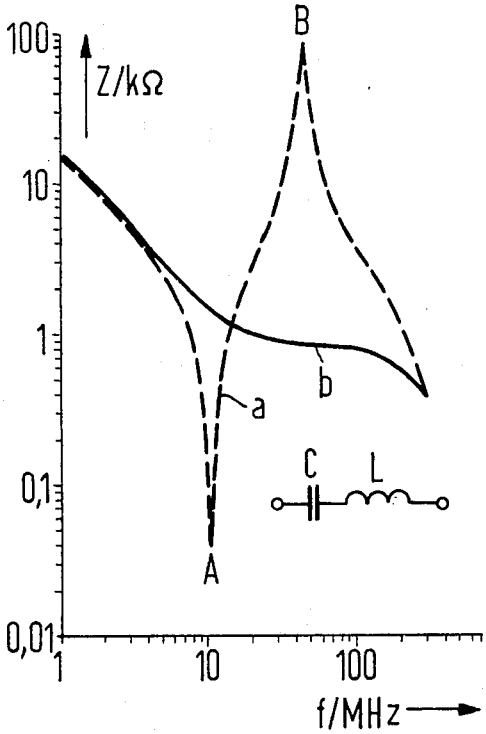
FIG. 4 is a graph which shows the way in which resonant points are eliminated by the use of a coil structure according to the present invention wherein the high resistance coil is dc connected to the low resistance coil.

FIG. 4 shows a logarithmic illustration showing the dependency of the amount of alternating current impedance Z on the frequency, f, for a choke according to the invention having an inductance of $L = 20/uH$. The other winding consists of a resistance wire of $R = 500$ ohms which is dc connected with the choke winding. In addition, to simulate parasitic capacitance, a capacitor with a capacitance of $C = 10pF$ was coupled in series with the arrangement.

The curve (*a*) shows the results of the series circuit capacitor-choke coil without the resistor winding. A specific series resonant A and self resonant B is illustrated.

The curve (*b*) shows the results of the series combination with the additional resistor winding. It is noted that the specific resonance points have disappeared.

Figure 5:
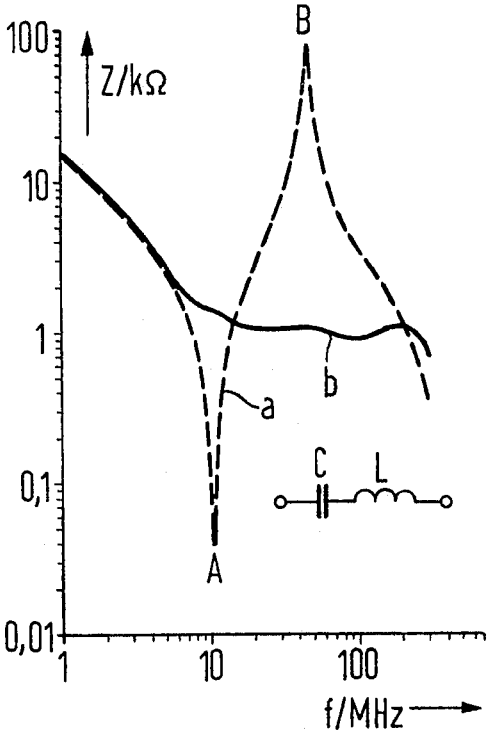
FIG. 5 is a graph similar to FIG. 2 showing, however, an arrangement wherein the high resistance coil is not dc connected to the low resistance coil.

FIG. 5 shows the results of the use of the components according to the invention when the additional resistor is not dc coupled to the choke winding. The measurements were taken place under the same conditions as in the case of FIG. 2, however, the resistance winding, had a direct current resistance of approximately 2000 ohms. It can be shown in the curve (*b*) that the resonance of peaks A and B of curve (*a*) have disappeared even though there was not a dc connection between the resistance winding and the choke winding. The choke coil structure according to this invention is well suited for the purpose of eliminating interferences created by electrical devices which develop high frequencies.

We claim:

1. A damped coil structure comprising a cylindrical core, a first winding of relatively low resistance wire wound directly on the core, a second winding of relatively high resistance material being directly wound against the first winding, the ferromagnetic core having outer connection parts embedded therein at opposite ends, the second winding being dc isolated from the first winding and having more than 25% more turns than the low resistance winding.

2. A damped coil structure in accordance with claim 1 wherein the second winding comprises a plastic-like foil being coated with a layer of resistance material, the foil being wound a number of times around the relatively low resistance winding.

3. A damped coil structure in accordance with claim 1 wherein the relatively low resistance winding is wound on the core in a plurality of layers and wherein a resistance layer is arranged between the layers.

4. A damped coil structure comprising a cylindrical core, a first winding of relatively low resistance wire wound directly on the core, a second winding of relatively high resistance material being directly wound against the first winding, the ferromagnetic core having outer connection parts embedded therein at opposite ends, the second winding having a dc connection to said first winding at the two ends and having more than 25% less windings than the low resistance winding.

5. A damped coil structure in accordance with claim 4, wherein the relatively low resistance winding is wound on the core in a plurality of layers and wherein a resistance layer is arranged between the layers.

6. A damped coil structure in accordance with claim 4 wherein the second winding comprises a plastic-like foil being coated with a layer of resistance material, the foil being wound a number of times around the relatively low resistance winding.

* * * * *